United States Patent [19]

Kircher

[11] 4,251,334

[45] Feb. 17, 1981

[54] METHOD AND APPARATUS FOR CONTROLLED, LOW CURRENT START-UP OF ONE OF A SERIES OF ELECTROLYTIC CELLS

[75] Inventor: Morton S. Kircher, Clearwater, Fla.

[73] Assignee: Olin Corporation, New Haven, Conn.

[21] Appl. No.: 130,950

[22] Filed: Mar. 17, 1980

[51] Int. Cl.[3] ..... C25C 15/02; C25C 9/00; C25C 9/04

[52] U.S. Cl. ..... 204/98; 204/128; 204/228; 204/253

[58] Field of Search ..... 204/98, 128, 228, 253, 204/258

[56] References Cited

U.S. PATENT DOCUMENTS

| | | | |
|---|---|---|---|
| 3,988,223 | 10/1976 | Hirozawa | 204/128 |
| 4,040,919 | 8/1977 | Eng | 204/128 |
| 4,169,775 | 10/1979 | Kuo | 204/228 |
| 4,197,169 | 4/1980 | Zahn et al. | 204/228 |

*Primary Examiner*—R. L. Andrews

*Attorney, Agent, or Firm*—Donald F. Clements; James B. Haglind

[57] ABSTRACT

A method and an apparatus for controlled, low current start-up of one of an electrical series of membrane electrolytic cells in which the currents through all but one of the remaining cells of the electrical series are unaffected. The method involves placing the cell to be started-up in electrical series with a variable resistor and placing the cell and resistor combination in parallel with the following or preceding one of the remaining cells in the electrical series and then slowly decreasing the resistance of the variable resistor over a preset time period so as to gradually increase the current to the cell being started up and finally eliminating the variable resistance altogether and reconnecting the cell being started-up in electrical series with the remaining cells.

8 Claims, 3 Drawing Figures

METHOD AND APPARATUS FOR CONTROLLED, LOW CURRENT START-UP OF ONE OF A SERIES OF ELECTROLYTIC CELLS

This invention relates to electrolytic cells and more particularly to methods and apparatuses for gradually starting current flow through such cells.

In the operation of electrolytic cells of almost all types, it is usual practice to connect a number such as from about 50 up to about 100 of cells in a series circuit for economic use of the electrical current. With the increasing cost and scarcity of energy supplies, it is most important to operate electrolytic cells for maximum energy efficiency. To remove a cell from the circuit, it is usual practice to shunt the current around the cell using a switch-connected, short-circuiting bus without reducing the current load on the circuit. This permits continuous production which is diminished only to the extent of one cell's output.

It has been determined by others that certain membranes used in the cell's electrolysis of alkali metal halide salt solutions require initial operation and reduced current density in order to avoid irreversible damage to the membrane characteristics. This is particularly true with respect to membranes having carboxylic acid moieties as the ion exchange groups. Methods which have been suggested for accomplishing this "breaking-in" or low current startup of the membranes are:

(1) reduction of current on the entire circuit for the required period, (2) pre-operation of the cell containing the new membrane or membranes in a separate facility prior to installation in the circuit, and (3) provision of a separate power source to "break-in" the cell in place in the cell room, before making final connection to the circuit.

Subsequent to the discovery of the present invention, Japanese patent publication 1979-61080 by Maruyama and H. Moritsu of Tokuyama Soda Kabushiki Kaisha disclosed a different approach to the problem of low current start up. However, even though subsequent, the Maruyama et al publication is useful in better understanding the present invention and it corroborates the existence of the problem of low current start-up requirements and evidence of a quite contrasting, less desirable approach to or solution of that problem. Maruyama et al teach connection of each of a multiplicity of electrolytic cells normally in parallel both with each other and with a rectifier. This is totally unlike the present invention where the cells are normally connected in an electrical series with each other and with the rectifier. The reason for this is believed to be that Tokuyama Soda utilizes very long, bipolar, filter press-type electrolytic cells which cannot practically or efficiently be connected only in series with other similar cells since repairs to even just one cell would then require shutting the whole series of cells (i.e. the whole plant) down since the cell is too long to be economically jumped with a portable jumper as can be done with shorter cells in series. Therefor Tokyama Soda and others install a series of bipolar electrolysis cells in parallel with another series of similar cells, each series having its own shut-off switch connected in series with only that cell so that cell can be shut down without interrupting production of the remaining cells. Such a system requires a lot of conductive material because of the parallel circuitry. However, low current start-up is done relatively easily by simply replacing each switch with a variable resistor; however, a large cell bank must be run at a low capacity during such startup. This is simply done by placing a variable resistor in parallel with the shut-off switch, opening the shut-off switch and then rapidly lowering the resistance in two steps. This method is not applicable to an electrical series of multicell units where only one of the series of cells is to be started-up, because the Tokyama Soda method would involve running the entire series of cells at a low current set by a variable resistor.

It is an object of the invention to provide a method for low current start-up of an electrolytic cell which only affects one of the remaining cells in the circuit without affecting others.

It is a further object of the invention to provide a method for returning one of an electrical series of electrolytic cells into connection and operation in the electrical series following removal of such cell for repairs.

These and other objects and advantages of the present invention are met by providing a method of connecting and starting-up one disconnected cell into a series of electrolytic cells having anode and cathode terminals connected in electrical series through a first shunt bypassing the disconnected cell, which method comprises the steps of:

electrically connecting said disconnected cell in parallel with an adjacent cell in said electrical series; and diverting a portion of the current which would normally flow through said adjacent cell so that part of said current flows instead through said formerly disconnected cell.

The objects and advantages of the invention will also be better understood by reference to the attached drawing in which.

Figure 1:
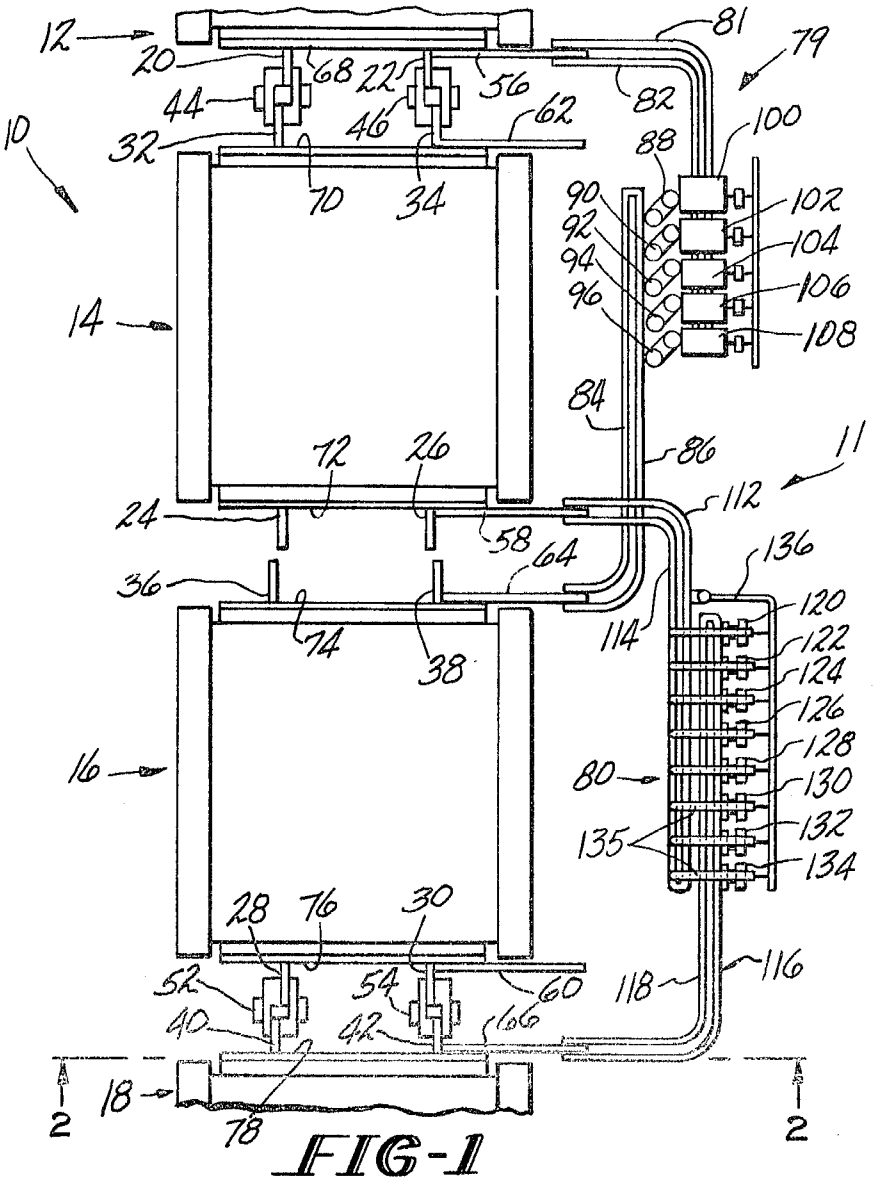
FIG. 1 is a top plan view of four electrolytic cells of an electrical circuit of any number of cells showing the preferred apparatus of the invention during start-up.

FIG. 1 is a top plan view of four electrolytic cells 12, 14, 16, and 18 which form a part of a series circuit 10 of similar electrolytic cells. A start-up system 11 is shown attached to cells 12, 14, 16 and 18 during the start-up procedure. Start-up system 11 includes a variable resistance shunt switch 79 and a short circuit shunt switch 80. Shunt switch 80 is included as part of system 11 even though it would normally already be in place, having been used to bypass an old or damaged cell which is being replaced by the cell to be started up. Cells 12, 14, and 16 each include two cathode terminals 20 and 22,24 and 26, and 28 and 30, respectively. Cells 14, 16 and 18 each include two anode terminals 32 and 34,36 and 38, and 40 and 42, respectively. Terminals 20 and 22 are connected to terminals 32 and 34 by intercell connectors 44 and 46, respectively. Terminals 28 and 30 are connected to terminals 40 and 42 by two intercell connectors 52 and 54, respectively. During the start-up procedure, terminals 24 and 26 are not connected to terminals 36 and 38, although once the start-up procedure is complete, two intercell (not shown) connectors would connect terminals 24 and 26 with terminals 36 and 38. Terminal 22 has a transverse shunt projection or shunt lug 56 which projects forward from between cell 12 and 14 out into an aisle along side circuit 10. Cathode terminals 26 and 30 also are provided with similar cathode shunt lugs 58 and 60 for use in short circuiting and start-up procedures. Anode terminals 34, 38, and 42 are provided in similar fashion with anode shunt lugs 62, 64 and 66 respectively for use in short-circuiting and start-up procedures. Cathode terminals 20 and 22 are connected by a cathode current collector 68. Cathode terminals 24 and 26 are similarly connected by a cathode current collector 72 and cathode terminals 28 and 30 are also connected by a cathode current collector 76. In similar fashion, anode terminals 32, and 34, 36 and 38, and 40 and 42 are connected by anode current collectors 70,74 and 78, respectively.

As noted above, start-up system 11 comprises a variable resistance shunt 79 and a short circuit shunt 80. Variable resistance shunt 79 comprises a pair of first legs 81 and 82, a pair of second legs 84 and 86, five water-cooled pipe resistors 88, 90, 92, 94 and 96, and five current interrupters 100, 102, 104, 106, and 108. First legs 81 and 82 are adapted to engage one of the shunt lugs 56–66. In the embodiment shown, for example, first legs 81 and 82 engage cathode shunt lug 56 of cell 12 and second legs 84 and 86 engage anode shunt lug 64 of the cell 16 being started-up. Current interrupters 100–108 serve to selectively connect first legs 81, 82 with second legs 84, 86 through one or more of resistors 88–96. Resistors 88–96 can be of any desired resistance, such as, for example, resistor 88, 90, 92, 94, and 96 could have resistances of 108 microhms, 70 microhms, 55 microhms, 50 microhms, and 6 microhms, respectively. The resistances in shunt 79 can be increased or decreased in number for finer, or coarser control. The resistances listed would be typical for inverted U-tubes of steel and copper, cooled by an ethylene glycol based coolant. Other types of resistors such as high temperature, air cooled, steel alloy resistors are also contemplated.

Short circuit shunt switch 80 comprises a pair of first legs 112 and 114, a pair of second legs 116 and 118, and two rows of current interrupters each row having eight current interrupters 120, 122, 124, 126, 128, 130, 132 and 134. The actual number of interrupters depends on the rated capacity of the cells and the number of cells being bypassed. Current interrupters 120–134 would preferably be water cooled in order to minimize damage due to overheating during short circuiting when extremely large currents pass through interrupters 120–134. For this purpose, a water supply line 138 and a water return line 136 are provided to and from interrupters 120–134, respectively. Legs 116, 118 are connected electrically to a first terminal of each of interrupters 120–134. Legs 114 are connected electrically through conductive straps 135 to a second terminal of current interrupters. The current's interrupters are, for example, Westinghouse vacuum switches.

Figure 2:
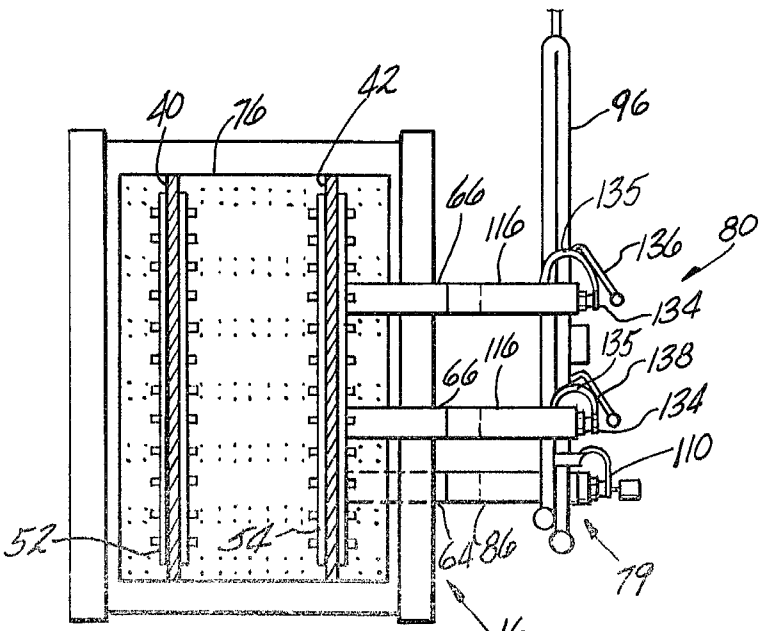
FIG. 2 is a vertical, cross-sectional, end view of the cell being started-up taken along line 2—2 of FIG. 1.

FIG. 2 is a vertical cross section taken along line 2—2 of FIG. 1 in order to better show the variable resistance shunt 79 and short circuit shunt 80. Short circuiting shunt 80 is seen to be connected to anode terminal 42 through shunt lug 66 while variable resistance shunt 79 is seen to be connected to terminal 38 through shunt lug 64. Short circuiting shunt 80 is connected to shunt lug 66 at two locations while variable resistance shunt 79 is connected to shunt lug 64 at only one location. The reason for this is that variable resistance shunt 79 is only expected to carry a maximum of less than about one-half the current which short circuiting shunt 80 is expected to carry during the start-up procedure. Other shunt lug connections could also be used. Variable resistance shunt 79 is adapted to pass below short circuiting shunt 80, in particular, second legs 84 and 86 of shunt 79 are adapted to pass below both pairs of first legs 112 and 114 of shunt 80 (also see FIG. 1) in order that shunt 79 and 80 do not come into electrical contact with each other. Also, pipe resistor 96 is quite high and it is, therefore, desirable that legs 84 and 86 be near the bottom of the cell in order that resistor 96 is not positioned too high for convenience. Shunts 79 and 80 are held in position by one or more support devices, not shown.

Figure 3:
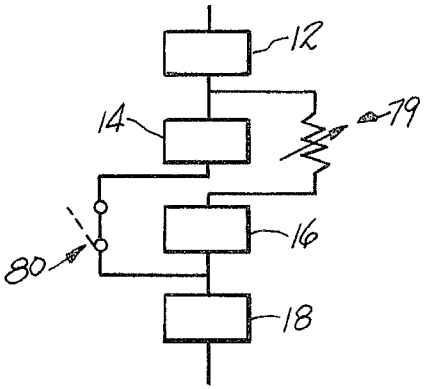
FIG. 3 is a schematic diagram showing the electrical circuit through the four cells of FIG. 1 during start-up.

FIG. 3 is a schematic diagram showing the electrical connection to cells 12, 14, 16, and 18 during start-up. FIG. 3 corresponds to FIG. 1 except that FIG. 1 shows a great deal of structural detail whereas FIG. 3 is greatly simplified for purposes of discussion. Prior to this start-up procedure, it is assumed that a damaged cell has been removed and replaced by an undamaged or "new" cell 16. Thus, before start-up, the current from cell 14 is already being diverted or bypassed through shunt 80 around cell 16 to cell 18 so that cell 16 has no current flowing through it. This was accomplished before the start-up procedure began by connecting short circuiting switch 80 to cells 14 and 18 and then disconnecting cell 14 from an old cell 16 and old cell 16 from cell 18. The old cell 16 is then removed and replaced by the new cell 16 shown in FIGS. 1–3 with new cell 16 in place and with short circuiting shunt 80 already carrying the current load around new cell 16, the start-up procedure is then followed to put new cell 16 into operation at maximum efficiency. First, variable resistance shunt 79 is electrically connected to cells 12 and 16 so that a portion of the current from cell 12 can be routed around cell 14 to cell 16. When this occurs, variable resistance shunt 79 can be gradually operated so as to gradually reduce the resistance of shunt 79 to thereby divert an increasing portion of the current from cell 12 around cell 14 to cell 16. Variable resistance shunt 79 is preferably of such resistance that no more than about one-half the current from cell 12 is diverted around cell 14 so that cell 14 is not shut down or run at too low a current during start-up. Although this limits the maximum current through cell 16 during start-up to no more than about one-half its normal current load, one-half the normal current load is sufficient for purposes of "breaking-in" or start-up over a predetermined time period. The required time period is determined by the type of membrane being "started". A typical time would be about two hours. This period can be set according to the start-up currents and times prescribed by membrane manufacturers or modified by membrane users or cell operators.

The specific procedure of connecting shunt 80 of FIG. 1, which occurs prior to the start-up procedure of the invention, is to contact the cathode terminal 26 through lug 58 of cell 14 with a first portion or first leg 112,114 of the short-circuiting shunt 80, and contact the anode terminal 42 through lug 66 of cell 18 with a second leg 116,118 of shunt 80, and then electrically connect the first and second legs through suitable high current switches. The method of attaching variable resistance shunt 79, with which the invention is partly concerned, is to contact the cathode terminal 22 through lug 56 of cell 12 with a first leg 81, 82 of shunt 79 and to contact the anode terminal 38 through lug 64 of cell 16 with a second leg 84, 86 of shunt 79 and then gradually electrically connect a parallel group of electrical resistors in sequence to both first legs 81,82 and second legs 84,86 in order to sequentially and gradually decrease the resistance of shunt 79 to thereby simultaneously decrease the current flowing to cell 14 while correspondingly increasing the current flowing through cell 16.

The system 11 is maintained in connected position for the required start-up period and then shunt 79 is removed and two intercell connectors (not shown) similar to connectors 44, 46, 52, and 54 are attached to terminals 24, 36, and 26, 38 to put cell 16 back in the series circuit. Shunt 80 is then removed so that the full current now passes through cells 14 and 16.

Although the start-up system 11 has been shown as being connected to cells 12 and 14 preceding the cell 16 to be started-up and to the cell 18 following cell 16, the system 11 could be modified by connecting shunt 79 to the cathode terminal 30 of cell 16 and to an anode terminal (not shown) of cell 18 and disconnecting intercell connectors 52 and 54 while connecting terminals 24, 26, with terminals 36, 38. To best visualize how this would appear, one can simply invert FIG. 1 so that shunt 80 appears above shunt 79 on the left hand side of the FIGURE and then imagining that cell 18 is the cell preceding the cell 16 to be started-up and cells 14 and 12 are, respectively, the first and second cells following the cell 16 to be disconnected.

While the invention has been shown in terms of one preferred embodiment and described in terms of a second inverted alternative, other modifications will suggest themselves to those of skill in the art of designing electrolytic cell systems. For example, although the start-up system 11 is shown in position beside the circuit 10 with legs projecting into engagement with shunt lugs attached to the anode and cathode terminals of the cells of the circuit, it will be understood that the start-up system 11 could alternatively be located underneath the cell or even overhead, if desired, and yet still be within the scope of the invention. Also, the FIGURES show a circuit of single cells 12,14,16, and 18 in electrical series, it could be utilized with multiunit cells depending on the voltage capacity of the current interrupters. Interrupters are currently available to handle up to about 10 volts and it is believed that current interrupters with up to about 50 volts capacity will become available. Since current cells operate at about 4 volts, two cell multiunits could now be handled with up to about 13 cell multiunits being handled with further development of the interrupter circuitry. Other similar modifications will likewise be found within the scope of the invention and the following claims are, therefore, to be accorded a broad range of equivalence.

What is claimed is:

1. A method of connecting and starting up one disconnected cell into a series of electrolytic membrane cells connected in electrical series through a first shunt bypassing the disconnected cell, which method comprises the steps of:

(a) electrically connecting said disconnected cell in parallel with an adjacent cell but in series with the remainder of the cells in said electrical series;

(b) diverting a portion of the current which would normally flow through said adjacent cell so that a portion of said current flows instead through said formerly disconnected cell; and (c) running both said formerly disconnected cell and said adjacent cell in parallel for a predetermined time, whereby the current through said formerly disconnected cell and said adjacent cell are both run at lower than normal current during said predetermined time so as to break-in a membrane of said formerly disconnected cell.

2. The method of claim 1 wherein:

said current diversion is through a variable resistor so that the magnitude of said lower than normal current can be varied.

3. The method of claim 2 wherein:

said lower than normal current is gradually increased over said predetermined time whereby said membrane is broken in gradually.

4. The method of claim 3 wherein:

said gradual current increase is made in discrete steps.

5. A method of connecting and starting-up one disconnected cell into a series of electrolytic cells having anode and cathode terminals connected in electrical series through a first shunt bypassing the disconnected cell, which comprises the steps of:

(a) contacting the cathode terminal of the second cell preceding said one cell with a first portion of variable resistance second shunt;

(b) contacting the anode terminal of said one cell with a second portion of said variable resistance shunt;

(c) electrically connecting said first and second portions of said variable resistance shunt through a resistance means to thereby divert a small portion of current from said second cell around said first cell to said one cell;

(d) gradually decreasing the resistance of said resistance means for a predetermined time period to thereby simultaneously decrease the current flowing to said preceding cell while increasing the current flowing in said one cell, no more than about one-half the current normally flowing to said preceding cell being diverted through said one cell;

(e) disconnecting said first and second portions of said variable resistance second shunt electrically first from each other and then from said second preceding and said one cells; and then (f) connecting the anode terminal of said one cell to the cathode terminal of said preceding cell; and (g) disconnecting said first and second portions of said first shunt first from each other and then from said preceding and following cells.

6. A method of connecting and starting-up one disconnected cell into series of electrolytic cells having anode and cathode terminals connected in electrical series through a first shunt bypassing the the disconnected cell, which comprises the steps of:

(a) contacting the cathode terminal of said one cell with a first portion of a variable resistance second shunt;

(b) contacting the anode terminal of the second cell following said one cell with a second portion of said variable resistance shunt;

(c) electrically connecting said first and second portions of said variable resistance shunt through a resistance means to thereby divert a small portion of the current from said preceding cell through said one cell rather than through said following cell;

(d) gradually decreasing the resistance of said resistance means for a predetermined time period to thereby simultaneously decrease the current flowing to said following pair while increasing the current flowing in said one cell, no more than about one-half the current normally flowing to said following cell being diverted through said one cell;

(e) disconnecting said first and second portions of said variable resistance second shunt electrically first from each other and then from said one cell and said second following cell;

(f) connecting the cathode terminal of said one cell to the anode terminal of said following cell; and (g) disconnecting said first and second portions of said first shunt electrically first from each other and then from said preceding and following cells to thereby cause the full current to pass in series from said preceding cell to said one cell and from said one cell to said following cell and then to said second following cell.

7. An apparatus for connecting and starting-up one disconnected cell into a series of electrolytic cells having anode and cathode terminals connected in electrical series through a first shunt bypassing the disconnected cell, which comprises:

(a) means for contacting the cathode terminal of the second cell preceding said one cell with a first portion of variable resistance second shunt;

(b) means for contacting the anode terminal of said one cell with a second portion of said variable resistance shunt;

(c) means for electrically connecting said first and second portions of said variable resistance shunt through a resistance means to thereby divert a small portion of current flowing from said second cell around said first cell to said one cell;

(d) means for gradually decreasing the resistance of said resistance means to thereby simultaneously decrease the current flowing to said preceding cell while increasing the current flowing in said one cell, no more than about one-half the current normally flowing to said preceding cell being diverted through said one cell;

(e) means for disconnecting said first and second portions of said variable resistance second shunt;

(f) means for connecting the anode terminal of said one cell to the cathode terminal of said preceding cell; and (g) means for disconnecting said first and second portions of said first shunt.

8. An apparatus for connecting and starting-up one disconnected cell one of a series of electrolytic cells having anode and cathode terminals connected in electrical series through a first shunt bypassing the disconnected cell, which comprises:

(a) means for contacting the cathode terminal of said one cell with a first portion of a variable resistance second shunt;

(b) means for contacting the anode terminal of the second cell following said one cell with a second portion of said variable resistance shunt;

(c) means for electrically connecting said first and second portions of said variable resistance shunt through a high resistance means to thereby divert a small portion of the current which would normally flow to said following cell through said one cell rather than through said following cell;

(d) means for gradually decreasing the resistance of said high resistance means for a predetermined time period to thereby simultaneously decrease the current flowing to said following pair while increasing the current flowing in said one cell, no more than about one-half the current normally flowing to said following cell being diverted through said one cell;

(e) means for disconnecting said first and second portions of said variable resistance second shunt;

(f) means for connecting the cathode terminal of said one cell to the anode terminal of said following cell; and (g) means for disconnecting said first and second portions of said first shunt to thereby cause the full current to pass in series from said preceding cell to said one cell and from said one cell to said following cell and then to said second following cell.

* * * * *